US007306047B2

(12) United States Patent
Oda et al.

(10) Patent No.: US 7,306,047 B2
(45) Date of Patent: Dec. 11, 2007

(54) IMPACT HAMMER DRILL

(75) Inventors: Hiroyuki Oda, Hitachinaka (JP); Yukio Terunuma, Hitachinaka (JP); Masayuki Ogura, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 98 days.

(21) Appl. No.: 11/049,688

(22) Filed: Feb. 4, 2005

(65) Prior Publication Data

US 2005/0173140 A1 Aug. 11, 2005

(30) Foreign Application Priority Data

Feb. 9, 2004 (JP) ..... P2004-031962

(51) Int. Cl.
*B25B 19/00* (2006.01)

(52) U.S. Cl. ..... 173/48; 173/206; 173/135; 173/138; 173/200

(58) Field of Classification Search ..... 173/48, 173/218, 135, 138, 200, 91, 104, 114, 168, 173/169; 91/165
See application file for complete search history.

(56) References Cited

U.S. PATENT DOCUMENTS 3,734,652 A * 5/1973 Barnett ..... 418/70
4,325,436 A * 4/1982 Richter et al. ..... 173/13
4,418,766 A * 12/1983 Grossmann ..... 173/13
4,505,340 A * 3/1985 Yantsen et al. ..... 173/208
4,529,044 A * 7/1985 Klueber et al. ..... 173/48
4,676,323 A * 6/1987 Henriksson ..... 173/200
4,712,625 A * 12/1987 Kress ..... 173/104
4,784,228 A * 11/1988 Ito ..... 173/208
5,025,869 A * 6/1991 Terunuma et al. ..... 173/98
5,044,254 A * 9/1991 Miller et al. ..... 91/277
5,056,606 A * 10/1991 Barthomeuf ..... 173/13
5,251,367 A * 10/1993 Ward et al. ..... 29/81.15
5,279,120 A * 1/1994 Sasaki ..... 60/413
5,320,177 A * 6/1994 Shibata et al. ..... 173/48
5,343,961 A * 9/1994 Ichikawa ..... 173/48
5,392,865 A * 2/1995 Piras ..... 173/17
5,769,620 A * 6/1998 Briem ..... 418/164
5,775,440 A * 7/1998 Shinma ..... 173/109
5,813,478 A * 9/1998 Kettner ..... 173/93
5,873,418 A * 2/1999 Arakawa et al. ..... 173/212

(Continued)

FOREIGN PATENT DOCUMENTS

JP 62-201642 12/1987

*Primary Examiner*—Brian Nash
(74) *Attorney, Agent, or Firm*—Antonelli, Terry, Stout & Kraus, LLP.

(57) ABSTRACT

An impact hammer drill capable of performing drilling operation at a high speed with low noise and without requiring a large thrust. The drill includes a main shaft rotatable by an output shaft of a motor, and a spindle having an impact-receiving section and disposed over the main shaft slidably in its axial direction and rotatable together with the rotation of the main shaft. A piston is reciprocatingly slidably disposed over the main shaft for impacting against the impact-receiving section. A piston drive unit is disposed for driving the piston with a compressed fluid. A compressed fluid supplying unit is disposed for supplying the compressed fluid to the piston drive unit. A drill bit is attachable to the spindle. When performing drilling operation, the drill bit is imparted with a combined rotational motion and the reciprocal impact motion.

12 Claims, 7 Drawing Sheets

U.S. PATENT DOCUMENTS 6,035,945 A * 3/2000 Ichijyou et al. ..... 173/48
6,073,706 A * 6/2000 Niemi ..... 173/206
6,155,353 A * 12/2000 Ottestad ..... 173/128
6,176,321 B1 * 1/2001 Arakawa et al. ..... 173/48
6,192,996 B1 * 2/2001 Sakaguchi et al. ..... 173/48
6,196,330 B1 * 3/2001 Matthias et al. ..... 173/48
6,196,331 B1 * 3/2001 Naito et al. ..... 173/169
6,209,659 B1 4/2001 Blessing
6,568,484 B1 * 5/2003 Schmid et al. ..... 173/201
6,644,418 B2 * 11/2003 Haga ..... 173/48
6,666,284 B2 * 12/2003 Stirm ..... 173/97
6,719,067 B2 * 4/2004 Taga ..... 173/93.5
6,763,897 B2 * 7/2004 Hanke et al. ..... 173/210
6,938,705 B2 * 9/2005 Kikuchi ..... 173/201
7,032,683 B2 * 4/2006 Hetcher et al. ..... 173/1

* cited by examiner

IMPACT HAMMER DRILL

BACKGROUND OF THE INVENTION

The present invention relates to a drilling machine, and more particularly, to a drilling machine that applies impacts on a target with a compressed air as a power source.

Conventionally, when drilling a concrete or the like, applying vibrational impacts, in addition to rotational motion, to a drill bit to crush a point of the concrete is known as the fastest drilling method. So as to apply such impacts to a drill bit, generally, part of rotational motion of a motor or the like that rotates a drill bit of a drilling machine is converted to reciprocating motion of a piston etc. arranged in the drilling machine. Then, impacts to be applied to the drill bit are generated from such reciprocating motion of the piston.

However, a drilling machine employing impacts cannot be used at places subject to noise regulation due to noise brought about when applying impacts. As a conventional drilling machine that is intended to be used at places subject to noise regulation with low noise, there is known a drilling machine for concrete structures disclosed in Laid-Open Japanese Utility Model Application Publication No. S62-201642. The drilling machine merely rotates a drill bit made mainly of diamond powder sintered metal, and the main body of the drilling machine is not provided with an impact mechanism for applying impacts to the drill bit.

However, when using a conventional drilling machine employing impacts, since part of motive energy to rotate a drill bit is used as motive energy to generate impacts, motive energy to rotate a drill bit is lowered, and intensity of thus generated impacts cannot be adjusted.

There is raised a problem that, when drilling concrete, the drilling speed of a drilling machine that employs only rotational motion and is not provided with an impact mechanism to apply impacts to a drill bit is extremely lowered when running into a high hardness aggregate such as a coarse aggregate. Furthermore, since the drilling operation is performed using friction generated between the leading end of a drill bit and a-concrete etc., the leading end of the drill bit has to be thrust against the concrete. Accordingly, when drilling a hard aggregate, an especially large thrust is required. In case the drilling operation is performed in a downward direction or in a transverse direction, a thrusting force can be obtained by employing the own weight of a drilling machine or the weight of a drilling worker. On the other hand, in case the drilling operation is performed in an upward direction, a drilling machine has to be uplifted and a load as a thrust has to be applied to the drill bit, which requires a hard labor.

As for drilling operation at places subject to noise regulation, the regulation may be varied depending on work time. Accordingly, for example, at least two drilling machines are required, one of which is for drilling operation employing impacts at a period of time with loosened noise regulation, while the other of which is for drilling operation employing only rotational motion at a period of time with tightened noise regulation. Furthermore, as for noise countermeasures, since a drilling machine has to be selected from only two drilling machines, that is, a drilling machine employing impacts with high noise and a drilling machine employing only rotational motion with low noise, there may be raised a case in which the drilling machine employing impacts cannot clear noise regulation while noise of the drilling machine employing only rotational motion is extremely low as compared with noise set down by noise regulation. In this case, the drilling machine employing only rotational motion alone can be used, which undesirably lowers working efficiency.

SUMMARY OF THE INVENTION

It is therefore an object of the present invention to overcome the above-mentioned drawbacks, and to provide a drilling machine capable of performing drilling operation at a high speed with low noise and without requiring a large thrust.

This and other objects of the present invention will be attained by a drilling machine including a frame, a motor, a rotation shaft, a piston, a piston drive unit, and a compressed fluid supplying unit. The motor is fixed within the frame and has an output shaft extending toward the one end of the frame. The rotation shaft is coupled to the output shaft to rotate about its axis, and extends toward the one end of the frame. The rotation shaft has a slidable section having one end provided with a drill bit attachment section and another end serving as an impact-receiving section. The piston extends in parallel with the axial direction, and is slidable in the reciprocatory manner in the axial direction to impact the impact-receiving section. The piston drive unit reciprocally drives the piston with a compressed fluid. The compressed fluid supplying unit is disposed within the frame for supplying the compressed fluid to the piston drive unit.

DETAILED DESCRIPTION OF THE PREFERRED EMBODIMENT

A drilling machine according to an embodiment of the present invention will be described with reference to FIG. 1 to FIG. 9. In the present embodiment, compressed air is used as a compressed fluid. One end of a drilling machine 1, having a drill bit 50 to be described later, is set to be the front side, while the other end thereof is set to be the rear side.

Figure 1:
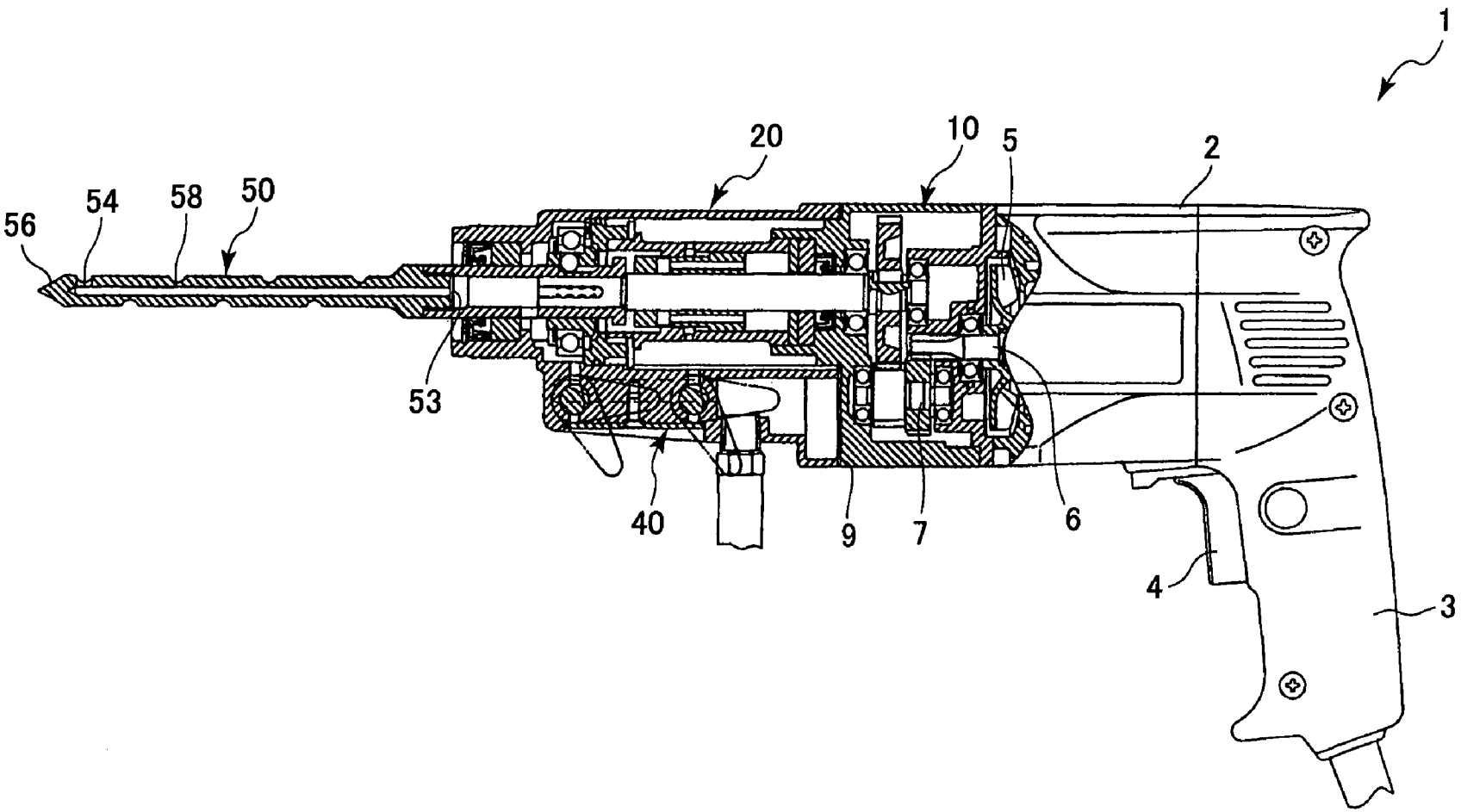
FIG. 1 is a side cross-sectional view showing a drilling machine according to an embodiment of the present invention.

The drilling machine 1 shown in FIG. 1 includes a housing 2 as a main frame of the drilling machine 1, a deceleration unit 10, a cylinder unit 20, a compressed air supplying unit 40, and a drill bit 50. The deceleration unit 10 is disposed at the front part of the housing 2. The cylinder unit 20 accommodating therein a piston drive unit is disposed at the front side of the deceleration unit 10. The compressed air supplying unit 40 is disposed at the front side of the housing 2 and below the cylinder unit 20. The drill bit 50 is disposed at the front side of the cylinder unit 20.

The housing 2, which configures a first frame together with a gear cover 11 to be described later, accommodates therein a motor (not shown) serving as a driving source of the drilling machine 1. An output shaft 6 extends from the motor toward the deceleration unit 10, and a fan 5 is fixed to the output shaft 6 for cooling the motor. A handle 3 integrally extends downward from a rear lower side of the housing 2. The handle 3 has a trigger 4, and has built therein a switching circuit (not shown) operated upon manipulation of the trigger for controlling the rotation of the motor.

Figure 2:
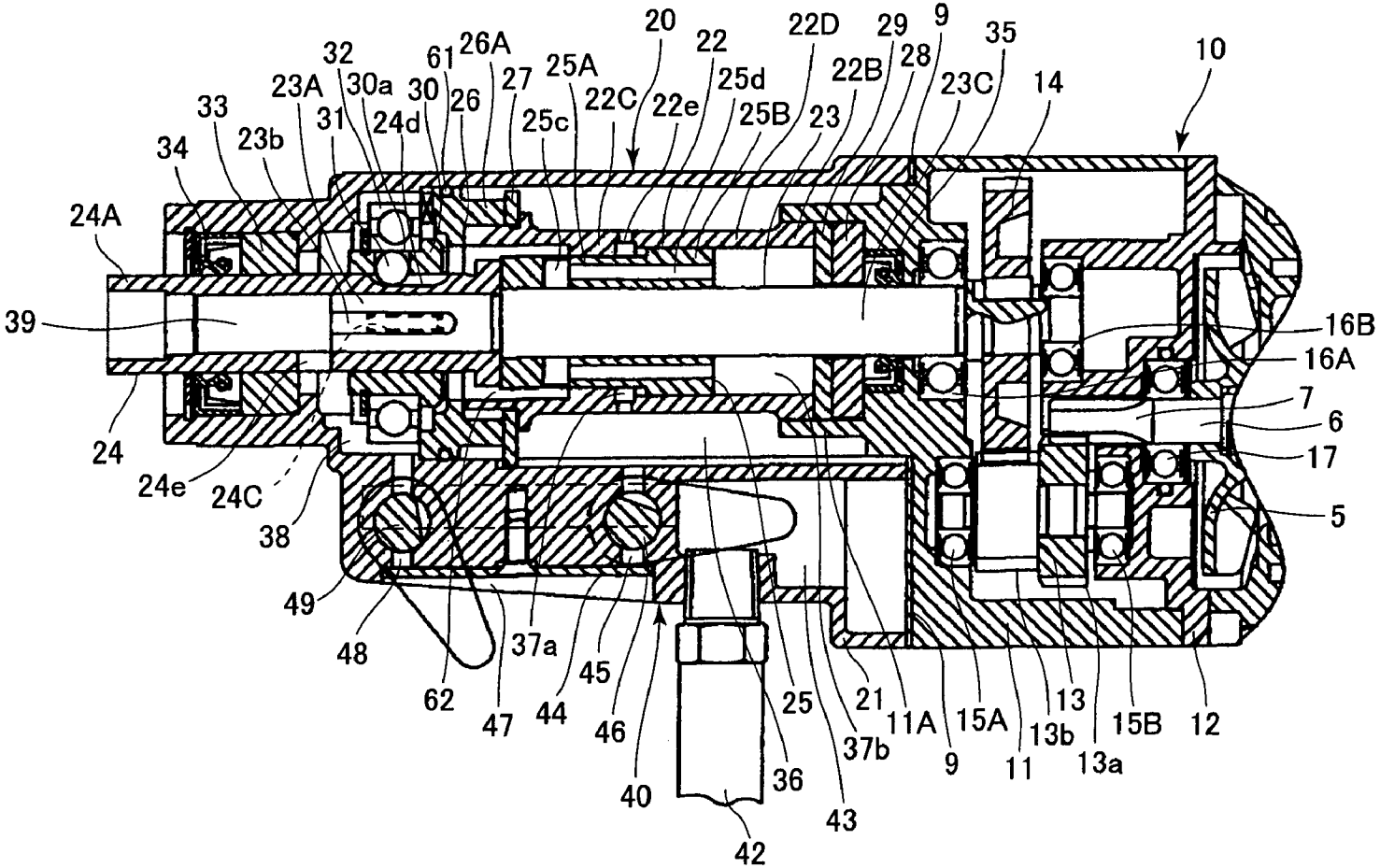
FIG. 2 is an enlarged side cross-sectional view showing an essential portion of the drilling machine according to the embodiment.

As best shown in FIG. 2, the deceleration unit 10 shown in FIG. 2 includes a gear cover 11 that configures the first frame together with the housing 2, and an inner cover 12. The deceleration unit 10 further includes a first gear 13 and a second gear 14 those disposed between the gear cover 11 and the inner cover 12. The inner cover 12 is in contact with the housing 2, and is fixed to the housing 2 with screws (not shown). A front end of the output shaft 6 penetrates through the inner cover 12, and has a pinion gear 7 attached thereto, so that the pinion gear 7 is disposed between the gear cover 11 and the inner cover 12. A bearing 17 is fit at the inner cover 12 for rotatably supporting the output shaft 6. In other words, the output shaft 6 extending from the motor is rotatably held by the inner cover 12 through the bearing 17.

The first gear 13 includes a first gear 13*a* meshedly engaged with the pinion gear 7, and a first pinion gear 13*b* integrally and coaxially disposed with the first gear 13*a*. The first gear 13*a* and the first pinion gear 13*b* are rotatably supported by the gear cover 11 and the inner cover 12 through a bearing 15A fit into the gear cover 11 and a bearing 15B fit into the inner cover 12. The second gear 14 is meshedly engaged with the first pinion gear 13*b* of the first gear 13. A main shaft 23(described later) has a rear end portion 23D concentrically fit with the second gear 14. Thus, the second gear 14 is coupled to the main shaft 23. The rear end portion 23D of the main shaft is rotatably held by the gear cover 11 and the inner cover 12 through a bearing 16A fit into the gear cover 11 and a bearing 16B fit into the inner cover 12.

In the cylinder unit 20, an outer hull is configured by the gear cover 11 as a first wall, and a substantially cylindrical cylinder cover 21 abutting on the gear cover 11 with a packing 9 interposed therebetween. The cylinder cover 21 is fixed to the gear cover 11 with screws (not shown). A cylindrical cylinder holding portion 11A protrudes from the wall of the gear cover 11 and extends in a direction perpendicular thereto. The cylindrical cylinder holding portion 11A is located in an internal space of the cylinder cover 21. A lower part of the cylinder cover 21 functions as an outer hull of the compressed air supplying unit 40 that is disposed at the lower part of the cylinder unit 20.

Figure 3:
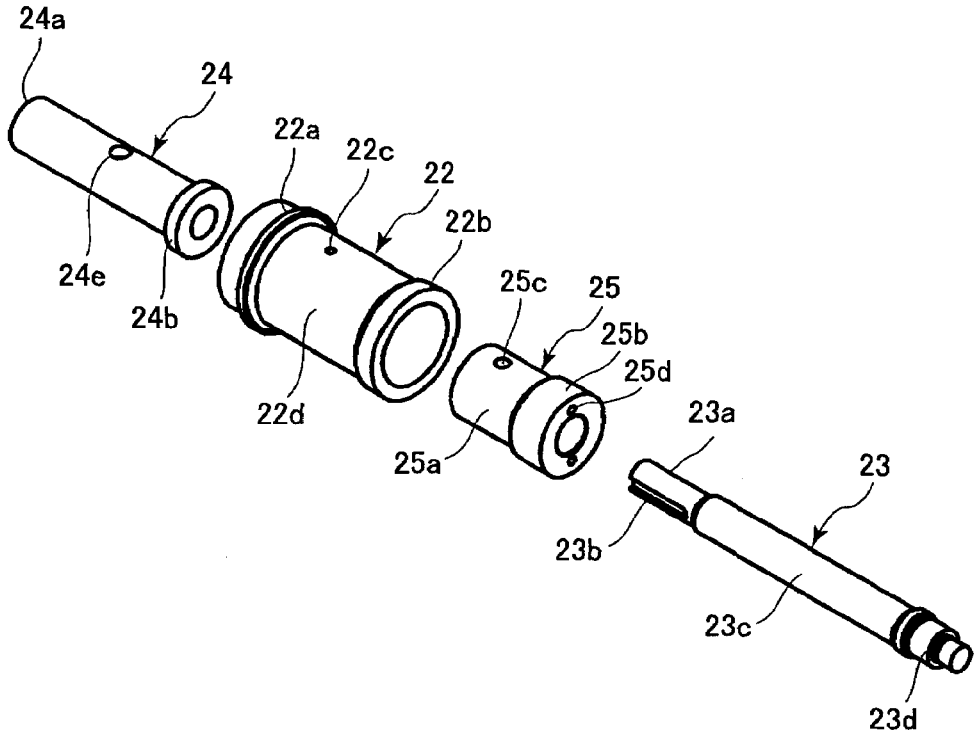
FIG. 3 is an exploded perspective view showing the relationship among a cylinder, a piston, a main shaft, and a spindle those being components of the drilling machine according to the embodiment.

A cylinder 22 that is a part of the piston drive unit is disposed in the internal space of the cylinder cover 21 that configures as a second frame. The cylinder 22 has a cylinder front end portion 22A and a cylinder rear end portion 22B as shown in FIG. 3. A spacer 26 which functions as a second wall is fitted into the inner space of the cylinder cover 21 as shown in FIG. 2, and a cylinder holding portion 26A extends from the spacer 26. The cylinder front end portion 22A is fitted into the cylinder holding portion 26A through a washer 27. The spacer 26 has a tubular shape through which the main shaft 23 extends. A clearance defined by the spacer 26, the rear end portion of the spindle 24, and a front inner peripheral surface of the cylinder 22 configures a discharge outlet 62 to discharge compressed air that have been introduced into the cylinder 22.

The cylinder rear end portion 22B is fitted into the cylinder holding portion 11A protruding from the gear cover 11 which functions as the first wall. A urethane washer 28 and a washer 29 are interposed between the rear end portion 22B and the cylinder holding portion 11A. Thus, the cylinder 22 is fixed in the inside the cylinder cover 21 at the cylinder front end portion 22A and cylinder rear end portion 22B. An O-ring 61 is interposed between the spacer 26 and the cylinder cover 21 for maintaining air-tightness between an anterior space and a posterior space of the spacer 26. Annular cylindrical space 36 is defined by the cylinder cover 21, the gear cover 11, the cylinder 22, and the spacer 26. The space 36 is located immediately outside of the cylinder 22. The housing 2, the gear cover 11, and the cylinder cover 21 form an outer frame of the drilling machine 1.

At the front inner peripheral surface of the cylinder 22, an annular inward projection 22C that protrudes radially inwardly is provided. At part of a cylinder trunk 22D located at the rear side vicinity of the annular inward projection 22C, a plurality of vent holes 22*e* are formed allowing fluid communication between the internal space of the cylinder 22 and the annular cylindrical space 36.

Inside the cylinder 22, a cylindrical piston 25 is slidably disposed. As shown in FIG. 3, the piston 25 includes a piston trunk 25A, and a piston rear end portion 25B with its diameter greater than that of the piston trunk 25A. The piston trunk 25A extends through the annular inward projection 22C at the front inner surface of the cylinder 22, while the piston rear end portion 25B extends through the cylinder trunk 22D. The piston trunk 25A has an outer diameter slightly smaller than an inner diameter of the annular inward projection 22C, while the piston rear end portion 25B has an outer diameter slightly smaller than an inner diameter of the cylinder trunk 22D. Thus, clearances are formed between the piston trunk 25A and the annular inward projection 22C, and between the piston rear end portion 25B and the cylinder trunk 22D. Each clearance is filled with a lubricant to bring about sealing effect, which keeps air-tightness between the anterior space and the posterior space of the annular inward projection 22C as well as between the anterior space and the posterior space of the piston rear end portion 25B, and also improves sliding performance of the piston 25.

Since the piston trunk 25A and the annular inward projection 22C are in hermetic relationship with each other while the piston rear end portion 25B and the cylinder trunk 22D are in hermetic relationship with each other, a space 37*a* is defined by the rear surface of the annular inward projection 22C, the inner surface of the cylinder trunk 22D located at the rear side of the annular inward projection 22C, a front end surface of the piston rear end portion 25B, and the outer surface of the piston trunk 25A located in front of the piston rear end portion 25B. The space 37*a* is in communication with the space 36 through the vent holes 22*e*, and has its volume varied depending on the position of the piston 25 relative to the cylinder 22.

The piston trunk 25A is formed with first holes 25*c* that extend from the outer peripheral surface thereof to the center of the piston 25. Further, the piston 25 is formed with second holes 25*d* extending in parallel with the axis of the piston 25 each second hole 25*d* has a front open end opened at the first hole 25*c*, and a rear open end opened at the rear end surface of the piston rear end portion 25B.

The main shaft 23 as a rotation shaft extends through the piston 25. As described above, the main shaft rear end portion 23D penetrates through the gear cover 11, and is fixed to the second gear 14. An oil seal 35 is provided between the gear cover 11 and the main shaft 23 for maintaining air-tightness between the main shaft 23 and the gear cover 11.

A main shaft trunk 23C has its outer diameter slightly smaller than the inner diameter of the piston 25. Thus, a clearance is formed between the piston 25 and the main shaft trunk 23C. The clearance is filled with a lubricant to bring about sealing effect, which keeps air-tightness between the anterior space and the posterior space of the piston 25, and also secures slidability of the piston 25 as well as rotating ability of the main shaft 23. Further, a space 37*b* is defined by the main shaft trunk 23C, the rear end face of the piston rear end portion 25B, the inner surface of the cylinder 22, and the washer 29. The space 37*b* is in communication with the first holes 25*c* through the second holes 25*d*.

A main shaft 23 has a front end portion 23A having a diameter slightly smaller than that of the main shaft trunk 23C. A pair of grooves 23*b* are formed at the outer surface of the main shaft front end portion 23A. The grooves 23*b* extend from the front end of the main shaft front end portion 23A in parallel with the axis of the main shaft 23.

A cylindrical spindle 24 is disposed over the main shaft front end portion 23A such that the spindle 24 is slidable in an axial direction thereof relative to the main shaft 23. The spindle 24 has a spindle front end portion 24A protruding from the front end of the cylinder cover 21. An internal female thread is formed at an inner peripheral surface of the spindle front end portion 24A for threading engagement with a male thread formed at the drill bit 50 to be described later. A spindle rear end portion 24B of the spindle 24 functions as an impact-receiving region to be impacted by the piston 25.

Figure 4:
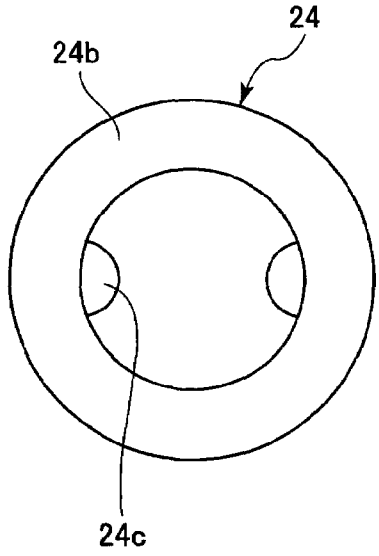
FIG. 4 is a view for description of a pair of spindle protrusions protruding radially inwardly of the spindle.
Figure 5:
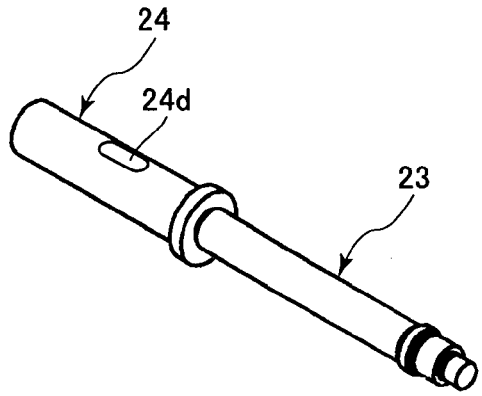
FIG. 5 is a perspective view showing an engagement state between the spindle and the main shaft in the drilling machine according to the embodiment.
Figure 6:
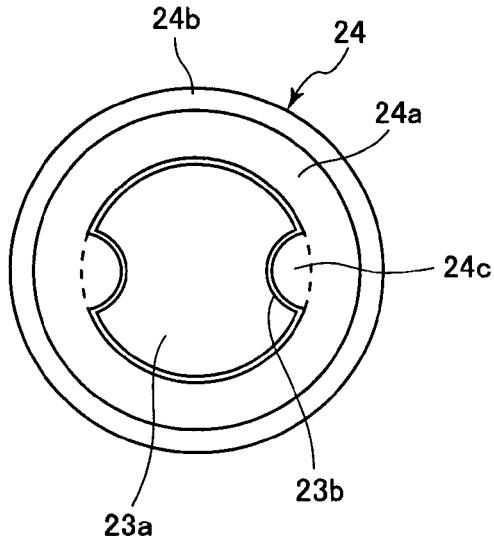
FIG. 6 is a view for description of the engagement between the spindle and the main shaft in the drilling machine according to the embodiment.

The rear portion of the inner peripheral surface of the spindle 24 is provided with a pair of spindle protrusions 24C that protrudes toward the center thereof, as shown in FIG. 4. The pair of the spindle protrusions 24C is insertedly engaged with the pair of the grooves 23*b* formed at the main shaft front end portion 23A of the main shaft 23. Thus, the spindle 24 cannot be rotated relative to the main shaft 23, but can slide in its axial direction relative to the main shaft 23, as shown in FIG. 5 and FIG. 6.

The spindle 24 has a second air path 39 formed therein, and is held by a metal piece 33 and a sleeve 30. The metal piece 33 is fitted into the cylinder cover 21, and has its inner diameter slightly larger than the outer diameter of the spindle 24. Thus, a clearance is defined between the metal piece 33 and the spindle 24. The clearance is filled with lubricant which enables the spindle 24 to rotate and slide relative to the metal piece 33. The sleeve 30 is fitted into an inner race of a bearing 32 that is fitted into the cylinder cover 21. Thus, the sleeve 30 is rotatable relative to the cylinder cover 21.

The sleeve 30 is formed with a hole 30*a* in which a steel ball 31 is inserted such that a spherical part thereof protrudes from the inner peripheral surface of the sleeve 30. A part of the outer peripheral surface of the spindle 24 over which the sleeve 30 is disposed is formed with an elongated groove 24*d* extending in parallel with the axis of the spindle 24, so that the part of the steel ball 31 can be received in the elongated groove 24*d* as shown in FIG. 2 and FIG. 5. The sleeve 30 has its inner diameter slightly larger than the outer diameter of the spindle 24. However, the clearance between the sleeve 30 and the spindle 24 is sized to prevent the steel ball 31 from dropping out of the elongated groove 24. Therefore, the steel ball 31 can move only within the groove 24*d*. Accordingly, the spindle 24 can slide relative to the sleeve 30 corresponding to the length of the groove 24*d* within which the steel ball 31 can move.

A clearance or a first air path 38 is defined by the sleeve 30, the bearing 32, and the cylinder cover 21. A part of the spindle 24 that always faces the first air path 38 is formed with an air hole 24*e* allowing fluid communication between the first air path 38 and the second air path 39.

An oil seal 34 is fitted into a part of the cylinder cover 21, the part being located ahead of the metal piece 33. The oil seal 34 is adapted to prevent dust attached to the surface of the spindle 24 that protrudes from the cylinder cover 21 and is exposed to the atmosphere from entering into the inside of the cylinder cover 21 as well as to block off the inside of the cylinder cover 21 from the atmosphere.

The compressed air supplying unit 40 has an air chamber 43 defined by the cylinder cover 21 and the packing 9. The compressed air supplying unit 40 mainly includes a coupling unit 42, an impact cock portion 44, and a cooling cock portion 47. The coupling unit 42 is coupled to a compressor (not shown) for introducing compressed air into the air chamber 43. The impact cock portion 44 is adapted to selectively shut off fluid communication between the air chamber 43 and the annular cylindrical space 36. The cooling cock portion 47 is adapted to selectively shut off fluid communication between the air chamber 43 and the first air path 38.

An impact air path 45 is formed in the impact cock portion 44 for providing fluid communication between the air chamber 43 and the annular cylindrical space 36. A cooling air path 48 is formed in the cooling cock portion 47 for providing a fluid communication between the air chamber 43 and the first air path 38. Compressed air is supplied from the compressor (not shown) to the air chamber 43. In the midstream of the impact air path 45 and in the midstream of the cooling air path 48, there are arranged an impact cock 46 and a cooling cock 49 for adjusting cross-sectional areas of these paths, respectively.

The drill bit 50 includes a stem section and a conical cutting edge section fixed to a front end of the stem section by brazing. The cutting edge is made from cemented carbide. The rear end portion of the stem section is formed with the male thread threadingly engaged with the female thread of the spindle 24 as described above. An air path 52 extends through the stem section. The air path 52 has a front open end serving as a discharge outlet 54 in the vicinity of the cutting edge 56 and a rear open end serving as an inlet 53 opened at the rear end surface of the drill bit 50 and is communicated with the second air path 39. Furthermore, the stem section has an outer surface formed with a spiral flute 58 connecting with the cutting edge 56.

Next, operation of the drilling machine 1 of the present embodiment will be described. When a drilling worker presses the drill bit 50 against an object to be drilled, not shown, such as a concrete wall, and pulls the trigger 4, the output shaft 6 of the motor (not shown) rotates. At this time, the fan 5 fixed to the output shaft 6 is also rotated to suck air into the housing 2 through slits (not shown) formed at the housing 2.

The first gear 13 is rotated, since the pinion gear 7 provided at the front end of the output shaft 6 is meshedly engaged with the first gear 13*a*. The rotation of the first gear 13 is transmitted to the second gear 14, since the first pinion gear 13*b* is meshedly engaged with the second gear 14. The main shaft 23 and the second gear 14 rotate concurrently, since the main shaft rear end portion 23D is concentrically connected to the second gear 14.

As described above, the spindle 24 is disposed over the main shaft front end portion 23A, and a pair of the spindle protrusions 24C is inserted into and engaged with a pair of the grooves 23*b* formed at the main shaft front end portion 23A. Thus, the spindle 24 can move freely along the axial direction thereof relative to the main shaft 23, and is fixed in the rotational direction. Therefore, the spindle 24 and the main shaft 23 rotate together. Since the drill bit 50 is fixed to the front end portion of the spindle 24, the drill bit 50 also rotates to drill a concrete wall etc.

When drilling a concrete wall, etc. by rotating the drill bit 50, the cutting edge 56 is pressed against the concrete wall, etc. to crush the pressed portion of the wall. At this time, temperature of the cutting edge 56 becomes high temperature due to friction. When this state is left intact, drilling capability is lowered because of change in material characteristics, etc. due to high temperature. Furthermore, when performing the drilling operation, a great amount of concrete dust is brought about around the cutting edge 56. When the concrete dust exists between the cutting edge 56 and the concrete wall, the cutting edge 56 cannot directly come into contact with the concrete wall, which lowers drilling capability. Therefore, the cutting edge 56 has to be cooled down and concrete dust has to be removed from the drilled hole.

To avoid this, compressed air supplied from the compressor is directed to and accumulated in the air chamber 43 through the coupling unit 42 in the compressed air supplying unit 40. The air chamber 43 communicates with the cooling air path 48, while the cooling air path 48 communicates with the first air path 38. Furthermore, the first air path 38 communicates with the second air path 39 through the air hole 24*e*. The front end of the second air path 39 faces the inflow inlet 53 that is formed at the rear end surface of the drill bit 50. Thus the compressed air in the air chamber 43 flows through the cooling air path 48,the first air path 38, the second air path 39 and the air path 52.

Accordingly, compressed air accumulated in the air chamber 43 is discharged out of the discharge outlet 54 formed in the vicinity of the cutting edge 56. When compressed air is discharged, the heat of the cutting edge 56 is removed and the cutting edge 56 is cooled down. In the drilled hole, compressed air discharged from the discharge outlet 54 is directed along the spiral flute 58 to the outside. Thus, concrete dust brought about around the cutting edge 56 is also discharged.

Since the cooling cock 49 is provided at the midstream of the cooling air path 48, amount of compressed air to be discharged from the discharge outlet 54 can be adjusted arbitrarily. Thus, amount of compressed air to be discharged can be adjusted depending on operating condition such as the number of revolutions of the drill bit 50.

As described above, a concrete wall, etc. can be drilled by rotational motion alone of the drill bit 50. In this case, since only rotational motion of the drill bit 50 occurs, noise brought about by the drilling operation is small. On the other hand, when the drill bit 50 abuts a coarse aggregate or a hard concrete such as a high strength concrete, drilling operation only with rotational motion of the drill bit 50 lowers working efficiency. Therefore, in this case, impacts are additionally applied to the drill bit 50.

The piston 25 impacts the spindle rear end portion 24B for applying impacts to the drill bit 50. Specifically, in the state shown in FIG. 2, compressed air is directed from the air chamber 43 to the space 37*a* through the impact air path 45, the space 36, and the vent holes 22*e*. In the state shown in FIG. 2, the piston 25 is located at the front end side, and the first hole 25*c* is located at the front side of the annular inward projection 22C and is opened only to the discharge outlet 62. Thus, the fluid communication between the space 37*a* and the space 37*b* is shut off. Accordingly, compressed air is accumulated in the space 37*a* and internal pressure thereof is increased, and thus internal pressure difference is established between the space 37*a* and the space 37*b*, which enlarges the space 37*a*.

Figure 7:
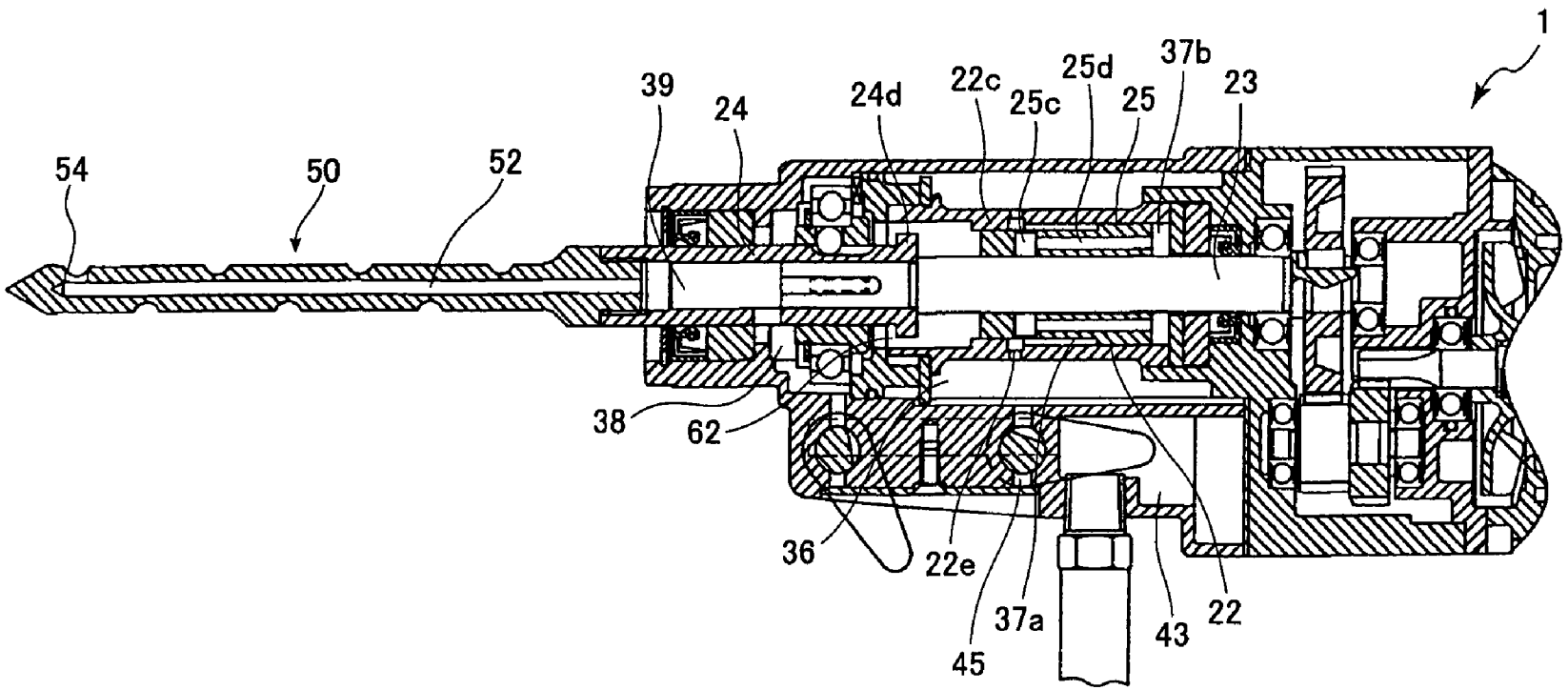
FIG. 7 is a side cross-sectional view showing a rearmost position of a piston of the drilling machine according to the embodiment.
Figure 8:
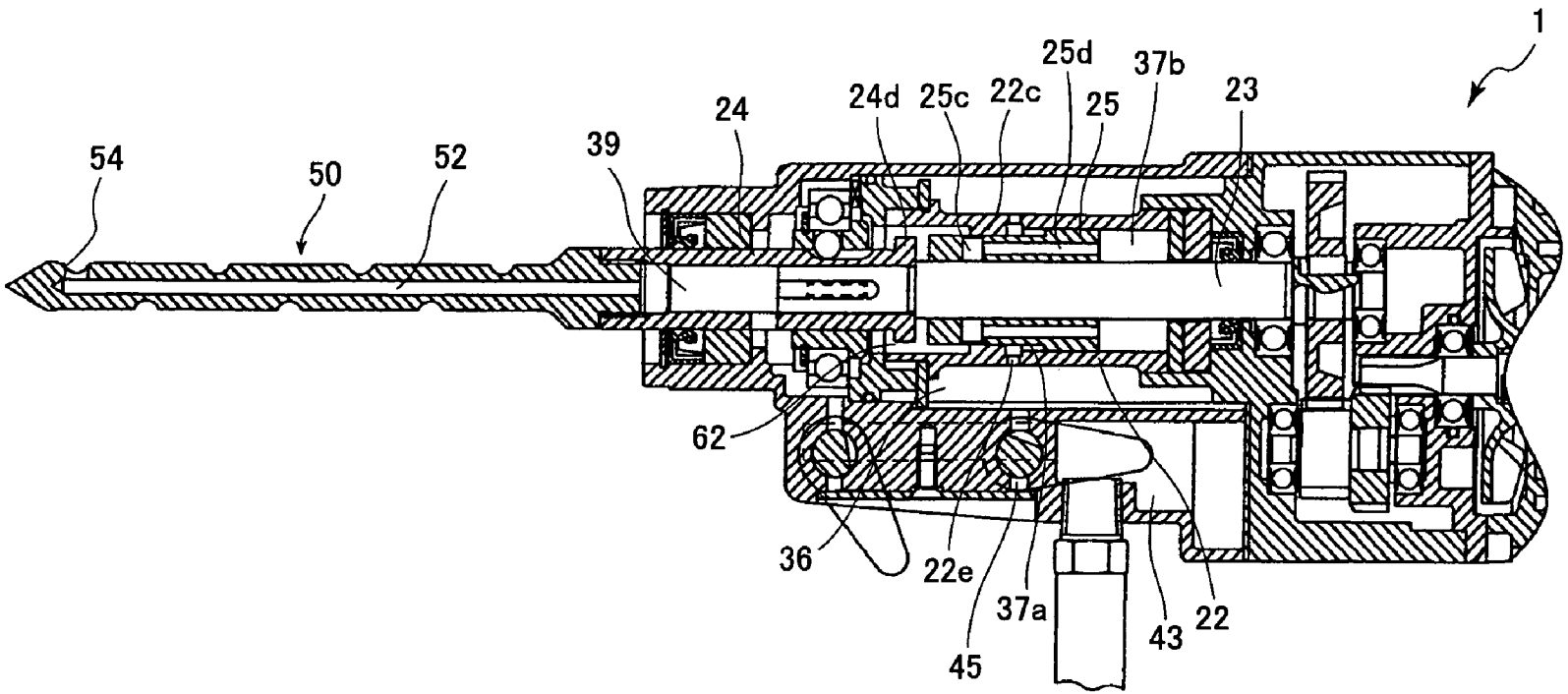
FIG. 8 is a side cross-sectional view showing a moving state of the piston from its rearmost position toward its frontmost position in the drilling machine according to the embodiment.

Because of the pressure increase in the space 37*a*, the piston 25 is moved toward the rear end side. Then, as shown in FIG. 7 when the piston 25 is moved to the rearmost position, the first holes 25*c* have moved past the annular inward projection 22C and are positioned at the rear side of the annular inward projection 22C. At this time, the space 37*a* communicates with the space 37*b* through the first holes 25*c* and the second holes 25*d*. Thus, internal pressure of the space 37*a* becomes equal to that of the space 37*b*. Further, since the discharge outlet 62 positioned at the front side of the piston 25 is in communication with the first air path 38 that communicates with the atmosphere through the discharge outlet 54, the pressure in the discharge outlet 62 is substantially equal to the atmospheric pressure. On the other hand, the space 37*b* located at the rear side of the piston 25, has its internal pressure substantially equalized with pressure of compressed air. As a result, pressure difference is established between the front side and the rear side of the piston 25. Thus, the piston 25 is moved toward the front side as shown in FIG. 8.

Figure 9:
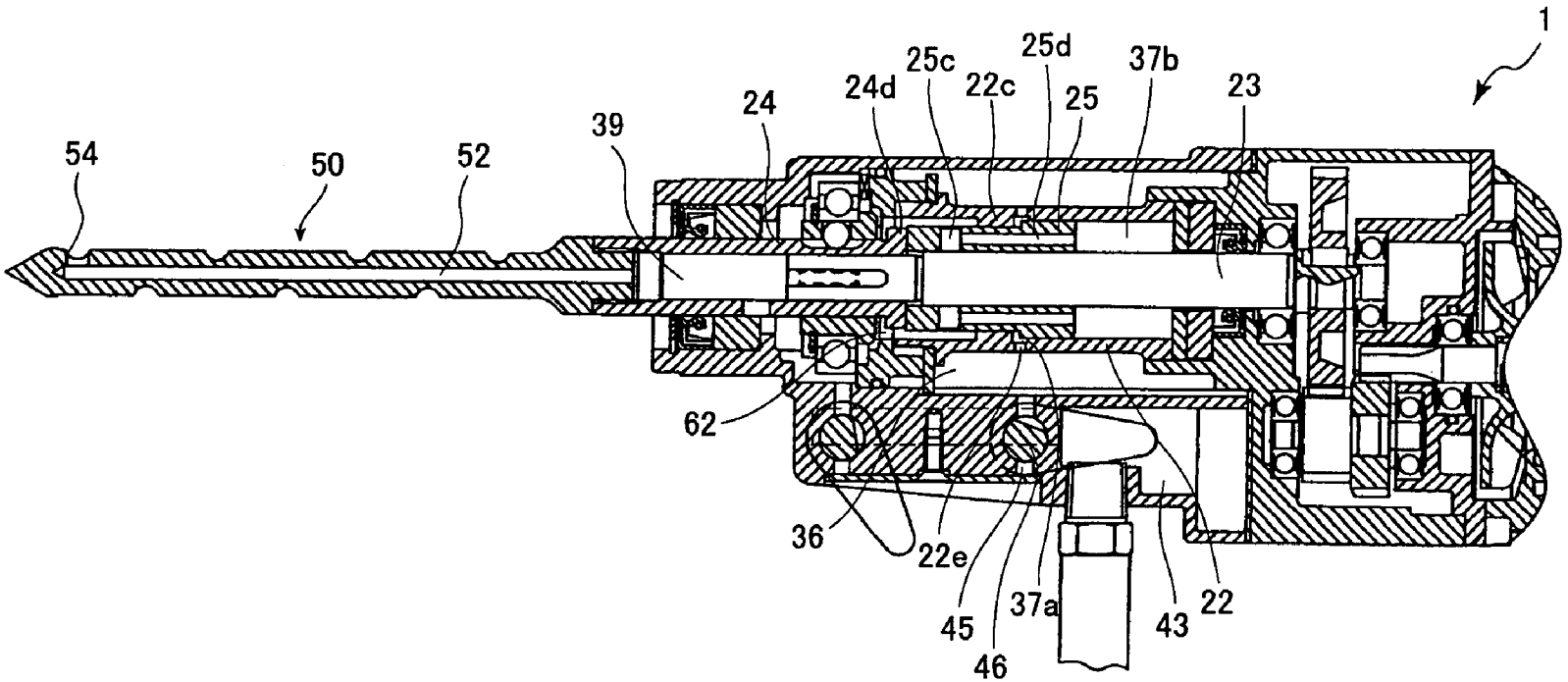
FIG. 9 is a side cross-sectional view showing the frontmost position, i.e., impact position of the piston of the drilling machine according to the embodiment.

During this frontward movement of the piston 25, the first holes 25*c* are moved past the annular inward projection 22C and are positioned at the front side of the annular inward projection 22C. Thus, the space 37*b* is brought into communication with the discharge outlet 62, so that the pressure in the space 37*b* becomes substantially equal to that of the discharge outlet 62. However, the piston 25 keeps moving forward due to inertial force, and then, as shown in FIG. 9, the piston 25 collides against the spindle rear end portion 24B to apply impacts to the drill bit 50 fixed to the spindle 24. At this time, the central axis of the piston 25 at which center of gravity thereof is located and the central axis of the spindle 24 at which center of gravity thereof is located are coaxial with each other, momentum of the piston 25 can be desirably transmitted to the spindle without dispersion of force.

Since the spindle 24 can slide freely along its axial direction independently of the main shaft 23, the spindle 24 and the drill bit 50 alone are moved when the piston 25 impacts the spindle 24. Since inertial masses of the spindle 24 and the drill bit 50 are small, impacts by the piston 25 can be desirably transmitted to the cutting edge 56. Further, since the spindle 24 can move freely relative to the main shaft 23, impacts transmitted to the spindle 24 are not transmitted to the main shaft 23. Accordingly, impacts are not transmitted to the second gear 14 fixed to the main shaft rear end portion 23D.

Then, the piston 25 moves backward due to reaction force of the collision, and returns to the initial position shown in FIG. 2. Then, a sequence of the operation is repeated, which consecutively impacts the spindle 24.

The motion of the piston 25 can be controlled by varying the pressure of the compressed air. Specifically, flow channel area of the impact air path 45 is varied by operating the impact cock 46 disposed at the midstream of the impact air path 45. Thus, amount of compressed air to be directed to the space 37*a* is varied, and accordingly, the expanding speed of the space 37*a* is varied. Consequently, the moving speed of the piston 25 is varied, and the impact intensity is also varied. When drilling operation with the impacts is desired at places where noise generation is restricted due to noise regulation or the like, the impact cock 46 is operated to adjust amount of compressed air so that drilling operation employing impacts can be performed under the noise regulation.

Further, compressed air directed to the space 37*a* which becomes motive energy to move the piston 25 is directed to the space 37*b* through the first holes 25*c* and the second holes 25*d*, and is then discharged from the discharge outlet 62 through the second holes 25*d* and the first holes 25*c*. Since the discharge outlet 62 communicates with the first air path 38, compressed air having been passed through the impact air path 45 is discharged from the discharge outlet 54 formed at the drill bit 50 to the atmosphere through the second air path 39 similar to compressed air passing through the cooling air path 48. This implies that the compressed air for the motive energy of the piston is also utilized for cooling purpose to the drill bit 50. The part where the spindle 24 is disposed over the main shaft 23 is not provided with sealing effect. Thus, compressed air discharged from the discharge outlet 62 can be directed to the second air path 39 through the minute clearance between the spindle 24 and the main shaft 23.

Accordingly, when large impacts are required, the cooling cock 49 is closed to shut off the cooling air path 48, whereas the impact cock 46 is open to direct the compressed air to the impact air path 45 to move the piston 25. In this case, entire compressed air can be exclusively used as motive energy source for the impact operation of the piston 25. Even in this case, since compressed air for applying impacts flows from the discharge outlet 62 to the first air path 38 and the second air path 39, compressed air can be discharged through the discharge outlet 54 for cooling down the drill bit 50 as well as for discharging concrete dust to the outside of the drilled hole through the flute 58.

As described above, since the driving power for rotating the drill bit 50 is exclusively provided by the motor, and the driving power for reciprocating the drill bit 50 is exclusively provided by the compressed air. In other words, power source for the rotational motion and the power source for reciprocating motion is independent of each other. Therefore, each motion can be controlled independently without mutual compensation.

While the invention has been described in detail and with reference to the specific embodiment thereof, it would be apparent to those skilled in the art that various changes and modifications may be made therein without departing from the sprit and scope of the invention. For example, the cooling air path 48 can be dispensed with. Even in the latter case, cooling down the drill bit 50 as well as discharging concrete dust to the outside of the drilled hole through the flute 58 can be achieved, since compressed air from the impact air path 45 can be discharged to the discharge outlet 54 through the discharge outlet 62, the first and second air paths 38, 39 and the air path 52 as described above.

As another modification, if cooling to the drill bit 50 with the compressed air is not required, the cooling air path 48 can be dispensed with and further, a discharge outlet corresponding to the discharge outlet 62 can be formed at the cylinder cover 21 or the like to directly discharge compressed air as the motive power source for the piston 25 to the atmosphere. In the latter case, compressed air can be smoothly discharged outside, which can enhance driving efficiency of the piston 25.

What is claimed is:

1. A drilling machine comprising:

a frame having one end;

a motor fixed within the frame and having an output shaft extending toward the one end of the frame;

a rotation shaft extending toward the one end of the frame and having an axis, the rotation shaft being coupled to the output shaft of the motor so as to rotate therewith, the rotation shaft including a slidable section disposed over an end portion of the rotation shaft which is configured so as to be slidable with respect to the rotation shaft and so as to prevent rotation of the slidable section with respect to the rotation shaft, the slidable section having one end provided with a drill bit attachment section and another end serving as an impact-receiving section;

a piston extending in parallel with an axial direction of the axis of the rotation shaft, and slidable in a reciprocatory manner in the axial direction to impact the another end of the slidable section;

a piston drive unit reciprocally driving the piston with a compressed fluid; and a compressed fluid supplying unit disposed within the frame for supplying the compressed fluid to the piston drive unit.

2. The drilling machine as claimed in claim 1, wherein the compressed fluid supplying unit comprises:

a coupling unit adapted to be coupled to a compressor which generates the compressed fluid;

an impact path forming portion that forms an impact path which communicates the coupling unit with the piston drive unit; and an impact path flow controlling unit disposed at the impact path for controlling a flow rate of the compressed fluid running through the impact path.

3. A drilling machine comprising:

a frame having one end;

a motor fixed within the frame and having an output shaft extending toward the one end of the frame;

a rotation shaft extending toward the one end of the frame and having an axis, the rotation shaft being coupled to the output shaft of the motor so as to rotate therewith, the rotation shaft including a slidable section having one end provided with a drill bit attachment section and another end serving as an impact-receiving section;

a piston extending in parallel with an axial direction of the axis of the rotation shaft, and slidable in a reciprocatory manner in the axial direction to impact the impact-receiving section;

a piston drive unit reciprocally driving the piston with a compressed fluid; and a compressed fluid supplying unit disposed within the frame for supplying the compressed fluid to the piston drive unit;

wherein the compressed fluid supplying unit comprises:

a coupling unit adapted to be coupled to a compressor which generates the compressed fluid;

an impact path forming portion that forms an impact path which communicates the coupling unit with the piston drive unit; and an impact path flow controlling unit disposed at the impact path for controlling a flow rate of the compressed fluid running through the impact path; and wherein the rotating shaft comprises:

a main shaft having one end, one end portion, and another end drivingly coupled to the output shaft, the main shaft being formed with grooves extending from the one end of the main shaft in the axial direction of an axis of the main shaft; and a cylindrical spindle functioning as the slidable section disposed over the one end portion of the main shaft, and slidable in the reciprocatory manner relative to the frame and the main shaft, the spindle having an inner peripheral surface, a front end functioning as the drill bit attachment section, and a rear end functioning as the impact-receiving section, the spindle also having protrusions protruding from the inner peripheral surface, each protrusion being slidably engageable with each groove to allow the spindle to be axially moved relative to the main shaft but prevent the spindle from being rotated relative to the main shaft.

4. The drilling machine as claimed in claim 3, wherein the piston is formed into a cylindrical shape, and is slidably disposed over the main shaft.

5. The drilling machine as claimed in claim 4, wherein the piston is concentric with the main shaft.

6. The drilling machine as claimed in claim 3, wherein the frame comprises a first frame having one end and housing therein the motor, and a second frame coupled to the one end of the first frame and housing therein the piston drive unit, the drill bit being protruding from the second frame when the drill bit is attached to the drill-bit attachment section.

7. The drilling machine as claimed in claim 6, wherein the first frame includes a first wall section disposed at a boundary between the first frame and the second frame; and wherein the piston drive unit comprises:

the first wall section rotatably supporting the main shaft;

a second wall section disposed in the second frame and fixedly supported thereto, the spindle extending through the second wall section and rotatably supported thereto;

a cylinder disposed in the second frame and supported by the first wall section and the second wall section, the rotation shaft extending through the cylinder, and the cylinder having an inner peripheral surface with which the piston is slidable, the cylinder being formed with at least one vent hole communicating with the impact path for introducing the compressed fluid into an internal space of the cylinder, a rear space being defined by the cylinder, the first wall section, the main shaft, and a rear end of the piston, and a fluid discharge space being defined by the cylinder, the second wall section, and a front portion of the piston.

8. The drilling machine as claimed in claim 7, wherein the inner peripheral surface of the cylinder is provided with an annular inward projection at a position immediately ahead of the at least one vent hole; and wherein the piston has an inner diameter substantially equal to an outer diameter of the main shaft, and is disposed between the cylinder and the main shaft; and wherein the piston is movable between a rearmost position near the motor and a frontmost position abutting the impact-receiving section, and the piston has a front section having an outer diameter subsequently equal to an inner diameter of the annular inward projection, and has a rear section having an outer diameter greater than that of the front section and subsequently equal to an inner diameter of the cylinder, and wherein the piston is formed with a first hole selectively communicated with the fluid discharge space, and a second hole providing communication between the first hole and the rear space, the first hole being positioned ahead of the annular inward projection for communication with the fluid discharge space when the piston is moved to the frontmost position, and being positioned rearward of the annular inward projection for communication with the impact path through the at least one vent hole when the piston is moved to the rearmost position.

9. The drilling machine as claimed in claim 8, wherein the spindle has a hollow cylindrical shape defining therein a fluid passage extending in an axial direction thereof, the spindle being formed with a radial through-hole in communication with the fluid passage; and wherein the frame is formed with a first fluid path forming portion that forms a first fluid path providing fluid communication between the radial through-hole and the fluid discharge space.

10. The drilling machine as claimed in claim 3, wherein the spindle has a hollow cylindrical shape defining therein a fluid passage extending in an axial direction thereof, the spindle being formed with a radial through-hole in communication with the fluid passage; and wherein the frame is formed with a first fluid path forming portion that forms a first fluid path providing fluid communication between the radial through-hole and the compressed fluid supplying unit.

11. The drilling machine as claimed in claim 10, wherein the compressed fluid supplying unit further comprises:

a cooling path forming portion that forms a cooling path allowing the coupling unit to communicate with the first fluid path; and a cooling path flow controlling unit disposed at the cooling path for controlling a flow rate of the compressed fluid running through the cooling path.

12. A drilling machine comprising:

a frame;

a motor disposed in the frame and having an output shaft;

a main shaft coupled to the output shaft of the motor so as to rotate therewith;

a spindle disposed over a portion of the main shaft and having one end provided with a drill bit attachment section and another end serving as an impact-receiving section, the spindle configured so as to be slideable with respect to the main shaft and so as to prevent rotation of the spindle with respect to the main shaft;

a cylinder disposed in the frame, at least a portion of the main shaft being surrounded by the cylinder;

a piston disposed between the cylinder and the main shaft and slidable in the reciprocatory manner to impact another end of the spindle;

a piston drive unit reciprocally driving the piston with a compressed fluid; and a compressed fluid supplying unit disposed within the frame for supplying the compressed fluid to the piston drive unit.

* * * * *